US005116036A

United States Patent [19]

LeRoy et al.

[11] Patent Number: 5,116,036

[45] Date of Patent: May 26, 1992

[54] DEVICE FOR FACILITATING STACKING OF SHEETS IN A HOPPER

[75] Inventors: Robert D. LeRoy, Rochester; Raymond M. Quackenbush, Hilton, both of N.Y.

[73] Assignee: Eastman Kodak Company, Rochester, N.Y.

[21] Appl. No.: 667,117

[22] Filed: Mar. 11, 1991

[51] Int. Cl.[5] ..... B65H 5/22

[52] U.S. Cl. ..... 271/3.1; 271/184; 271/220; 271/902

[58] Field of Search ..... 271/3.1, 165, 184, 220, 271/224, 902

[56] References Cited

U.S. PATENT DOCUMENTS

| | | | |
|---|---|---|---|
| 345,644 | 7/1886 | Moseman | 271/224 |
| 372,410 | 11/1887 | Haffner | 271/224 |
| 411,750 | 9/1889 | Reiffel | 271/224 |
| 2,585,076 | 2/1952 | Bandura et al. | 271/224 X |
| 2,733,064 | 1/1956 | Martin | 271/224 |
| 2,957,691 | 10/1960 | Williams | 271/224 X |
| 3,022,999 | 2/1962 | Mead | 271/224 |
| 3,907,128 | 9/1975 | Cathers | 271/224 X |
| 3,957,264 | 5/1976 | Bach et al. | 271/173 |
| 3,968,364 | 7/1976 | Miller | 250/237 R |
| 3,977,668 | 8/1976 | Bologna et al. | 271/126 |
| 4,056,264 | 11/1977 | Dhooge et al. | 271/177 |
| 4,143,960 | 3/1979 | Tracy | 355/3 R |
| 4,340,213 | 7/1982 | Jensen | 271/219 |
| 4,364,553 | 12/1982 | Wilson | 271/219 |
| 4,380,332 | 4/1983 | Davis | 271/224 |
| 4,385,758 | 5/1983 | Ellsworth | 271/224 |
| 4,406,449 | 9/1983 | Buck | 271/189 |
| 4,441,702 | 4/1984 | Nagel et al. | 271/177 |
| 4,469,319 | 9/1984 | Robb et al. | 271/3.1 |
| 4,789,150 | 12/1988 | Plain | 271/220 |
| 4,844,435 | 7/1989 | Giannetti et al. | 271/10 |
| 5,022,640 | 6/1991 | Greco, Jr. | 271/3.1 |

FOREIGN PATENT DOCUMENTS

| | | | |
|---|---|---|---|
| 31856 | 2/1983 | Japan | 271/224 |
| 244865 | 10/1987 | Japan | 271/224 |
| 212670 | 9/1988 | Japan | 271/224 |

*Primary Examiner*—H. Grant Skaggs
*Assistant Examiner*—Boris Milef
*Attorney, Agent, or Firm*—Lawrence P. Kessler

[57] ABSTRACT

A device for facilitating stacking of sheets in a hopper of a sheet transporting apparatus in which sheets are directed seriatim onto a stack of sheets in the hopper and subsequently fed seriatim from the stack of sheets in the hopper. The facilitating device comprises at least one elongated member supported at one end thereof for substantially free pivotable movement in a vertical plane under the influence of gravity. The support for the elongated member is located to particularly position the elongated member whereby a sheet directed onto the stack in the hopper will strike the elongated member. The elongated member absorbs kinetic energy of the directed sheet to stop such sheet movement and pivot the elongated member in a first direction about the support and, when the elongated member pivots in the direction opposite the first direction under the influence of gravity, the elongated member strikes the sheet to urge the sheet into accurate operative engagement with the sheet feeder.

8 Claims, 2 Drawing Sheets

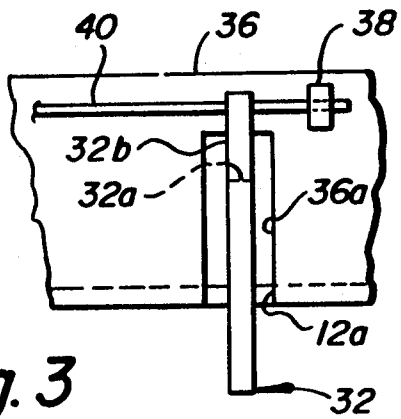
Fig. 3
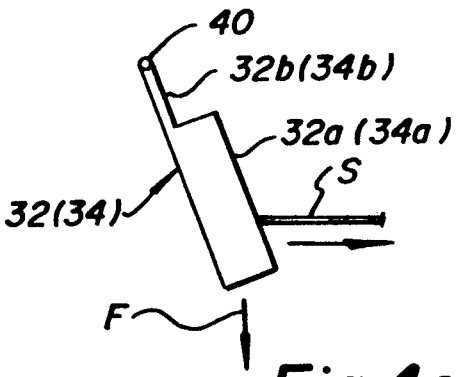
Fig. 4c
Fig. 2
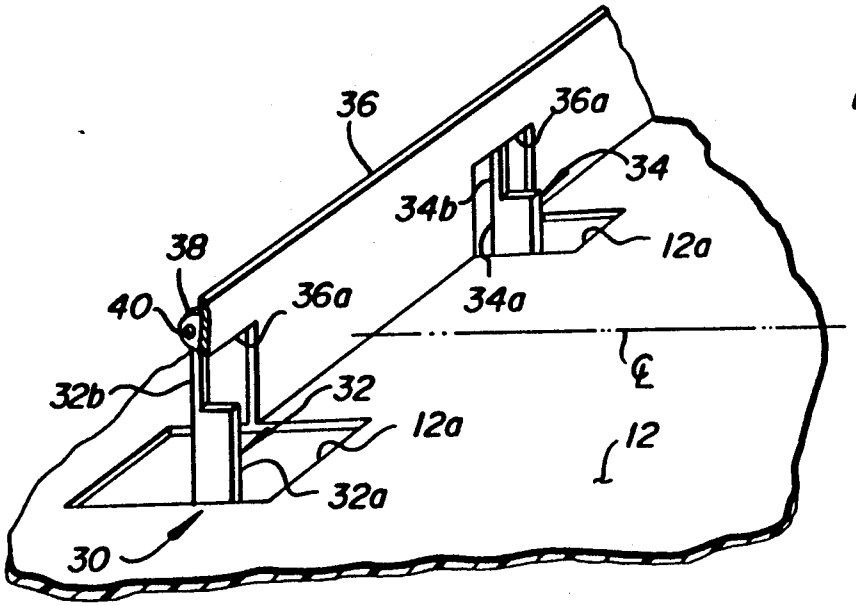
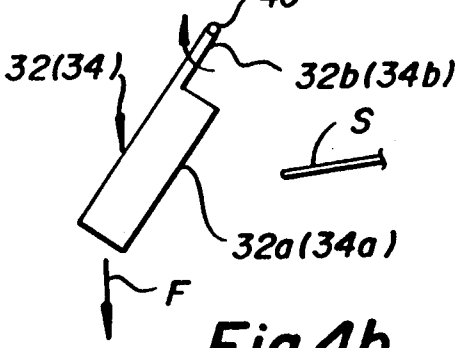
Fig. 4b
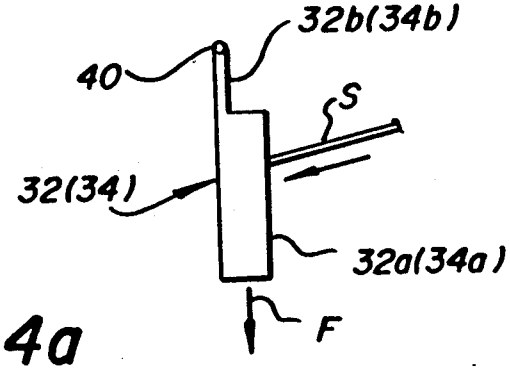
Fig. 4a

DEVICE FOR FACILITATING STACKING OF SHEETS IN A HOPPER

BACKGROUND OF THE INVENTION

This invention relates in general to sheet transport apparatus, and more particularly to a device for facilitating stacking of sheets in a hopper of a sheet transport apparatus.

In various sheet transport apparatus, it is a common requirement that sheets, travelling in stages along a travel path, be accurately located at some point in the path for effective transport in aligned relation to downstream process stations. For example, in certain transport apparatus, sheets are accumulated in a stack and, at a subsequent time, are fed from the accumulated stack to a downstream station. In some instances, the overall geometry of the transport apparatus necessitates that the sheets fed from the stack be fed in a direction substantially opposite to the direction of the sheets as they are directed for accumulation in the stack. This change in direction of the sheets in this portion of the transport cycle introduces complications into the transport apparatus construction in that proper alignment of the sheets in the stack at the feeder is necessary to assure the effective transport in aligned relation to the downstream process station.

Control of sheets directed to a stack is typically accomplished by a strip of material located to intercept the sheet travel path to the stack. Such strip of material, referred to as a dangler, serves to slow a sheet down as the sheet is directed at a relatively high speed to the stack. Danglers, however, are not generally capable of accurately aligning sheets in the stack relative to the mechanism for feeding sheets from the accumulated stack. A common device for accurately aligning sheets in the stack relative to the sheet feed mechanism includes a jogger which periodically tamps the edge of the sheet stack into accurate alignment with the feed mechanism. However, joggers are not generally used to stop sheet travel because when used in that manner they tend to damage the tamped edge of the individual sheets. Accordingly, in order to provide for sheet travel direction change and accurate stack alignment in a sheet transport of the type described above, a relatively complex arrangement is required which employs both danglers and joggers.

SUMMARY OF THE INVENTION

This invention is directed to a device of simplified construction for facilitating accurate stacking of sheets in a hopper of a sheet transporting apparatus in which sheets are directed seriatim onto a stack of sheets in the hopper and subsequently fed seriatim from the stack of sheets in the hopper. The facilitating device comprises at least one elongated member supported at one end thereof for substantially free pivotable movement in a vertical plane under the influence of gravity. The support for the elongated member is located to particularly position the elongated member whereby a sheet directed onto the stack in the hopper will strike the elongated member. The elongated member absorbs the kinetic energy of the directed sheet to stop such sheet movement and pivot the elongated member in a first direction about the support and, when the elongated member pivots in the direction opposite the first direction under the influence of gravity, the elongated member strikes the sheet to urge the sheet into aligned operative engagement with the sheet feeder.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 2 is a view in perspective to the device for facilitating stacking of sheets in a hopper according to this invention;

FIG. 3 is a rear elevational view of the device for facilitating stacking of sheets in a hopper according to this invention; and FIGS. 4*a*–4*c* are side elevational views showing, in sequence, the steps of operation for the device for facilitating stacking of sheets in a hopper according to this invention.

DETAILED DESCRIPTION OF THE PREFERRED EMBODIMENT

Figure 1:
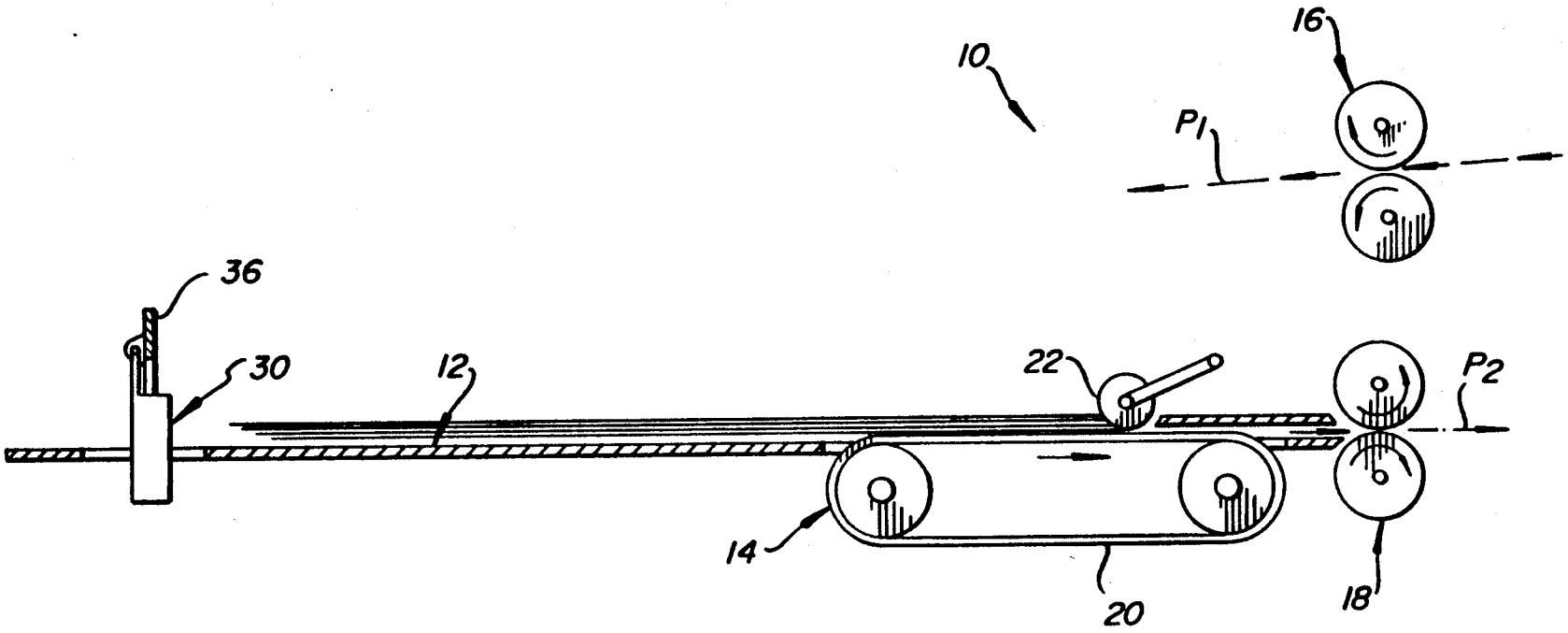
FIG. 1 is a side elevational view, partly in cross-section, of a sheet transport apparatus including the device for facilitating stacking of sheets in a hopper according to this invention, with portions apparatus shown schematically, removed, or broken away to facilitate viewing.

Referring now to the accompanying drawings, FIG. 1 shows an exemplary sheet transport apparatus, designated generally by the numeral 10. The transport apparatus 10 is of the type having sheets directed seriatim thereto along a first travel path $P_1$, accumulated in a hopper 12, and subsequently fed seriatim from the hopper by a feed mechanism 14 along a second travel path $P_2$ toward a downstream location (e.g., process station) in a direction opposite the direction of sheet travel in the travel path $P_1$. Devices for transporting sheets respectively in the paths $P_1$ and $P_2$ are schematically shown as nip roller pairs 16 and 18 rotating in the direction of the associated arrows. The feed mechanism 14 is shown as a scuff feeder arrangement including a feed belt 20 and a retard member 22. The retard member 22 overlies the feed belt 22 to form a cooperative feed nip therewith. Sheets have to be accurately positioned relative to such feed nip to assure proper feeding of sheets by the mechanism 14 (that is, without multi-sheet feeds or misfeeds) toward the downstream location. An illustrative example of a typical sheet feed mechanism suitable for use in this sheet transport apparatus is shown in U.S. Pat. No. 4,844,435 (issued July 4, 1989, in the names of Giannetti et al). In order to reverse the direction of travel of the sheets directed to and subsequently fed from the transport apparatus 10 and assure accurate sheet positioning at the feed nip of the mechanism 14, such apparatus includes a device for facilitating stacking of sheets according to this invention (see particularly FIGS. 1–3). The facilitating device, designated generally by the numeral 30, includes a pair of substantially identically constructed pendulum-like elongated members 32 and 34 particularly mounted on a support 36. Of course, the number of pendulum-like members is dependent upon the overall transport apparatus geometry and may be of any suitable number from one to many.

The elongated members 32, 34 of the device 30 respectively have a weighted portion 32*a*, 34*a*, suspended from an arm 32*b*, 34 *b*. The support 36 includes an upstanding plate attached to the hopper 12. The support 36 includes a pair of spaced flanges 38 in which a shaft 40 is mounted for substantially free rotation about its longitudinal axis. The respective arms 32*b*, 34*b* of the elongated members 32, 34 are attached to the shaft 40 such that the elongated members are free to pivot with the shaft, about the longitudinal axis thereof, in a vertical plane under the influence of gravity. The plate 36 and the hopper 12 respectively define openings 36*a* and 12*a* which enable swinging action of the elongated members to occur without impedance by the plate or hopper surfaces. The respective points of attachment of the arms 32*b*, 34*b* to the shaft 40 are selected so as to space the elongated members at equal distances from the centerline $C_L$ of sheet travel through the apparatus 10 (see FIG. 2).

The function of device 30 to accomplish accurate stacking of sheets in the hopper 12 of the sheet transporting apparatus 10 is best described with particular reference to FIGS. 4*a*–4*c*. An incoming sheet S, directed to the sheet stack in hopper 12 by the nip roller pair 16, strikes the weighted portions 32*a*, 34*a* of the elongated members 32, 34 (FIG. 4*a*). The kinetic energy in the moving sheet is absorbed by, and imparted to, the elongated members causing the sheet to come to a stop and the elongated members to swing in unison about the longitudinal axis of the shaft 40. The maximum degree of angular rotation of the elongated members 32, 34 (see FIG. 4*b*) is of course determined by the weight of the members (under the influence of gravity, designated by the letter F) and the kinetic energy imparted to the members. Accordingly, to the well known physical theory of pendulum mechanics, from the maximum degree of angular rotation of the elongated members 32, 34, such members will store kinetic energy as they swing back in the opposite direction about the longitudinal axis of the shaft 40 under the influence of gravity through their substantially vertical position. When the elongated members swing back as described, the members will strike the sheet S and transfer the stored kinetic energy to the sheet to move the sheet in the opposite direction (see FIG. 4*c*).

Based on various factors (such as sheet weight, sheet velocity, elongated member weight and geometry for example), the kinetic energy imparted to the sheet by the elongated members 32, 34 on their return swing is sufficient to urge the sheet into proper accurate operative engagement in the feed nip of the feed mechanism 20. In the preferred embodiment, sheet weight in terms of standard sheet weight measurement standards is in the range of about 16 to 110 pounds, and sheet velocity is about 30 inches per second. As such, the elongated members 32, 34 are each configured to be about one inch long with a weight of about 0.25 ounces (with a total combined weight of the interrelated members being about 0.5 ounces). This arrangement has been found to effectively change the sheet travel direction and impart enough energy to the sheet to redirect the sheet movement and accurately locate the sheet in operative engagement with the feed nip of the feed mechanism 14 for sheet weights within the given range. Moreover, since the initial transfer of kinetic energy from the incoming sheet to the elongated members does not of course occur instantaneously, damage to the edge of the sheet is substantially prevented.

The invention has been described in detail with particular reference to preferred embodiments thereof, but it will be understood that variations and modifications can be effected within the spirit and scope of the invention.

We claim:

1. In a sheet transporting apparatus having a hopper for supporting a stack of sheets, means for directing sheets seriatim onto a stack of sheets in said hopper, means for feeding sheets seriatim from said stack of sheets in said hopper, and means for facilitating stacking of sheets in said hopper, said facilitating means comprising:

at least one elongated member including an arm and a weighted portion extending from one end thereof, and means for supporting said elongated member at the end of said arm opposite said weighted portion for substantially free pivotable movement in a vertical plane under the influence of gravity, said support means being located to particularly position said elongated member whereby a sheet directed onto said stack in said hopper will strike said weighted portion of said elongated member to absorb kinetic energy of the directed sheet to stop such sheet movement and pivot said elongated member in a first direction about said support away from such sheet and, when said elongated member pivots in the direction opposite the first direction under the influence of gravity, said weighted portion of said elongated member strikes said sheet to urge said sheet into operative engagement with said feeding means.

2. The invention of claim 1 wherein said facilitating means includes a pair of elongated members of substantially identical construction.

3. The invention of claim 2 wherein each of said elongated members of said pair of elongated members is spaced a substantially equal distance from the centerline of sheet travel in said sheet transporting apparatus.

4. The invention of claim 2 wherein said support means includes a shaft, said arms of said respective elongated members mounted on said shaft for rotation about the longitudinal axis of said shaft.

5. The invention of claim 4 wherein said shaft is in turn supported for free rotation about its longitudinal axis and said arms of said elongated members are attached to said shaft for rotation in unison therewith.

6. A sheet transporting apparatus comprising:

a hopper for supporting a stack of sheets;

means for directing sheets seriatim onto a stack of sheets in said hopper;

means for feeding sheets seriatim from said stack of sheets in said hopper;

at least one pendulum-like member having an elongated arm and a weighted portion at one end thereof; and means for supporting said pendulum-like member at the end opposite the weighted portion end for substantially free pivotable movement in a vertical plane under the influence of gravity, said support means being in turn supported by said hopper so as to particularly position said pendulum-like member whereby a sheet directed onto said stack in said hopper will strike said weighted portion of said pendulum-like member to absorb kinetic energy of the directed sheet to stop such sheet movement and pivot said pendulum-like member in a first direction about said support away from such sheet and, when said pendulum-like member pivots in the direction opposite the first direction under the influence of gravity, said weighted portion of said pendulum-like member strikes said sheet to urge said sheet into operative engagement with said feeding means.

7. The invention of claim 6 including a pair of pendulum-like members of substantially identical construction, each of said pendulum-like members of said pair of pendulum-like members being spaced a substantially equal distance from the centerline of sheet travel in said sheet transporting apparatus.

8. The invention of claim 7 wherein said support means includes a shaft supported for free rotation about its longitudinal axis, said pendulum-like members being attached to said shaft for rotation in unison therewith about the longitudinal axis of said shaft.

* * * * *